US008974207B2

(12) United States Patent
Bodzak

(10) Patent No.: US 8,974,207 B2
(45) Date of Patent: Mar. 10, 2015

(54) GEAR PUMP

(75) Inventor: Stanislaw Bodzak, Elsbethen (AT)

(73) Assignee: Robert Bosch GmbH, Stuttgart (DE)

( * ) Notice: Subject to any disclaimer, the term of this patent is extended or adjusted under 35 U.S.C. 154(b) by 509 days.

(21) Appl. No.: 13/387,408

(22) PCT Filed: Jun. 8, 2010

(86) PCT No.: PCT/EP2010/057973
§ 371 (c)(1),
(2), (4) Date: Feb. 29, 2012

(87) PCT Pub. No.: WO2011/012364
PCT Pub. Date: Feb. 3, 2011

(65) Prior Publication Data

US 2012/0148426 A1 Jun. 14, 2012

(30) Foreign Application Priority Data

Jul. 31, 2009 (DE) ..... 10 2009 028154

(51) Int. Cl.

| | |
|---|---|
| ***F01C 1/10*** | (2006.01) |
| ***F04C 15/00*** | (2006.01) |
| ***F04C 2/08*** | (2006.01) |
| ***F04C 2/10*** | (2006.01) |
| ***F04C 11/00*** | (2006.01) |

(52) U.S. Cl.
CPC ..... *F04C 15/008* (2013.01); *F04C 2/086* (2013.01); *F04C 2/102* (2013.01); *F04C 11/008* (2013.01); *F04C 2230/22* (2013.01)
USPC ..... 418/171; 417/410.4; 418/166

(58) Field of Classification Search
USPC ..... 417/410.4, 420; 418/166, 171
See application file for complete search history.

(56) References Cited

U.S. PATENT DOCUMENTS

| | | | | |
|---|---|---|---|---|
| 4,570,093 | A * | 2/1986 | Morii et al. | 310/46 |
| 5,219,276 | A | 6/1993 | Metzner et al. | |
| 6,270,324 | B1 | 8/2001 | Sullivan et al. | |
| 6,544,019 | B2 | 4/2003 | Martin et al. | |
| 7,137,793 | B2 | 11/2006 | Shafer et al. | |
| 7,314,352 | B2 | 1/2008 | Nakayoshi et al. | |
| 8,033,796 | B2 * | 10/2011 | Kameya et al. | 417/44.11 |

(Continued)

FOREIGN PATENT DOCUMENTS

| | | |
|---|---|---|
| CN | 200989300 | 12/2007 |
| DE | 102006007554 | 8/2007 |
| WO | 2008017543 | 2/2008 |

OTHER PUBLICATIONS

PCT/EP2010/057973 International Search Report, 4 pages.

*Primary Examiner* — Devon Kramer
*Assistant Examiner* — Patrick Hamo
(74) *Attorney, Agent, or Firm* — Michael Best & Friedrich LLP

(57) ABSTRACT

This invention relates to a gear pump (1) for delivering a fluid, comprising an externally toothed gearwheel (3) rotatably mounted on a journal (4), and an internally toothed annular gear (2), the gearwheel and gear meshing so as to produce a delivery action, and arranged together with an electrically commutatable stator (7) inside a housing (5). The stator (7) extends concentrically around the annular gear (2) and cooperates with a magnetic ring (6) in order to generate an electromotive force and the magnetic ring (6) together with the annular gear (2) rotate in order to produce the delivery action. The annular gear (2) is mounted by means of a sliding bearing (25).

7 Claims, 5 Drawing Sheets

(56) References Cited

U.S. PATENT DOCUMENTS

2005/0265860 A1 12/2005 Kameya et al.
2006/0038457 A1* 2/2006 Miyata ..... 310/156.45
2008/0159885 A1* 7/2008 Kameya et al. ..... 417/410.4
2009/0167104 A1* 7/2009 Dunn et al. ..... 310/198
2010/0183454 A1 7/2010 Lübke et al.

* cited by examiner

GEAR PUMP

BACKGROUND OF THE INVENTION

Gear pumps comprise, amongst other things, internal gear pumps and annular gear pumps in which a driving gearwheel runs eccentrically in the internal tooth system of an annular gear. Internal gear pumps, which are particularly suitable for providing high pressures, are used to deliver fluids, for example to deliver fuel to an internal combustion engine.

In the prior art, it is known to integrate internal gear pumps or annular gear pumps in an electronically commutated electric motor, with the rotor of the electric motor simultaneously being in the form of an annular gear of the internal gear pump or annular gear pump.

DE 10 2006 007 554 A1 describes a delivery pump which is integrated in an electric motor. The delivery pump comprises a first gearwheel and a second gearwheel. A delivery space is formed between the two gearwheels. The second gearwheel is mounted at its center on a mandrel. The first gearwheel is an external gearwheel and forms the rotor, the second gearwheel is an internal gearwheel which is carried along in the eccentric center of the first gearwheel. The first gearwheel comprises glued-in permanent magnets which are arranged in a manner distributed over the circumference. External magnetic field generators generate a circulating rotationally changing field which results in direct motorized tracking of the rotor.

However, mounting of the annular gear, which has to adopt the drive torque of the electric motor, is problematical in configurations of this kind. At the same time, the hydraulic forces of the internal gear pump have to be transmitted to the stator and further to the pump housing.

EP 1 600 635 A2 describes an internal gear pump which has a pump section with an internal rotor which is formed with teeth on its outer periphery. An external rotor has teeth which are formed on its inner periphery. Both rotors are accommodated in a housing. The external rotor, which is in the form of an annular gear, is mounted by means of specially shaped additional components in this case.

The solutions known in the prior art for mounting the annular gear in an internal gear pump or in an annular gear pump have a mechanically complicated design and are therefore structurally elaborate, complex and expensive in terms of production.

Therefore, it is necessary to provide a simple and cost-effective solution for mounting an annular gear for an internal gear pump or an annular gear pump.

SUMMARY OF THE INVENTION

The invention provides a gear pump for delivering a fluid, having an externally toothed gearwheel, which is rotatably mounted on a bearing pin, and an internally toothed annular gear which engage in a meshing manner for the purpose of generating a delivery effect and which are arranged in a housing together with an electrically commutatable stator, with the stator extending around the annular gear in a concentric manner and interacting with an annular magnet for the purpose of generating an electromotive force, with the annular magnet together with the annular gear executing a rotary movement for the purpose of generating the delivery effect, with the annular gear being mounted by a sliding bearing. A structurally simple and therefore cost-effective solution for mounting is provided by mounting the annular gear using a sliding bearing.

The annular magnet is preferably arranged between the stator and the annular gear. In this case, the annular magnet does not have the task of providing a sliding bearing. The tasks of a sliding bearing are advantageously adopted by other components of the internal gear pump and the annular gear itself.

In a yet further preferred embodiment, the annular magnet and the annular gear are connected to one another in a rotationally fixed manner. Therefore, a drive torque is transmitted from the rotating electromagnetic field to the annular magnet and further to the annular gear of the internal gear pump or annular gear pump. The annular magnet itself does not adopt a bearing function. Said bearing function is advantageously adopted by other components, preferably by the annular gear itself.

Further preference is given to the annular gear being produced from a non-magnetic material. This provides magnetic decoupling between the individual components.

According to a further preferred embodiment, the annular gear is mounted by an annular section which is formed at least on a surface, which is opposite the annular gear, in the form of a sliding bearing.

A second radial gap with a value of 0.1 to 0.5 mm is preferably formed between the stator and the annular magnet.

According to a further preferred embodiment, the annular section is integrally formed with the housing and projects radially inward from said housing.

According to yet a further preferred embodiment, the annular section is pressed or glued into the housing.

Preference is also given to mounting the annular gear by a disk-like element which has a bearing pin which projects from the disk-like element and which is accommodated in a cutout which is correspondingly provided in the housing. The surface of the bearing pin is preferably in the form of a sliding bearing. As an alternative, an inner wall of the recess can be in the form of a sliding bearing. In this embodiment, the fuel connections are to be produced in the housing.

BRIEF DESCRIPTION OF THE DRAWINGS

Exemplary embodiments of the invention will be described in greater detail below with reference to the appended drawings, in which.

DETAILED DESCRIPTION

Figure 1:
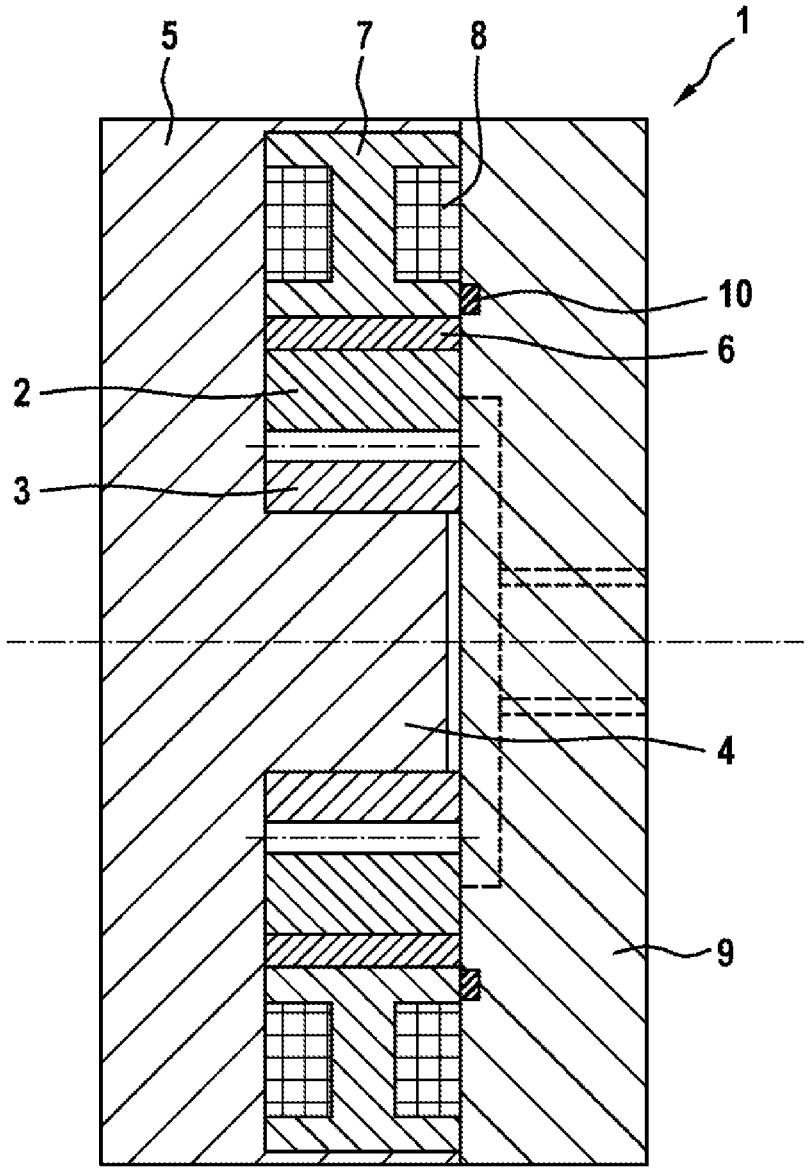
Fig. 1 Prior art
FIG. 1 shows a section through an internal gear pump according to the prior art.

FIG. 1 shows a section though an internal gear pump 1 according to the prior art. The internal gear pump 1 comprises a pair of gearwheels which comprises an internally toothed annular gear 2 and an externally toothed gearwheel 3. The gearwheel 3 is arranged in a rotatable manner on a bearing pin 4 eccentrically with respect to the annular gear 2. If the annular gear 2 is made to rotate, the external tooth system of the gearwheel 3 meshes with the internal tooth system of the annular gear 2 and generates a volumetric delivery flow of the fluid, in which the tooth system runs. The pair of gearwheels comprising the annular gear 2 and the gearwheel 3 is arranged in a housing 5, with the bearing pin 4 being formed in one piece or integrally with the housing 5. Furthermore, the annular gear 2 is connected to an annular magnet 6 in a rotationally fixed manner, with the annular magnet 6 extending around the annular gear 2 in a radially encircling manner. The annular magnet 6 runs in an inner face of a stator 7 which has an electrical winding 8. If the electrical winding 8 is electrically commutated by a control means, a circulating magnetic field is generated in the stator 7. On account of the circulating magnetic field, the annular magnet 6 is made to rotate, with the tooth system comprising the annular gear 2 and the gearwheel 3 also being made to operate on account of the rotationally fixed connection between the annular magnet 6 and the annular gear 2. The annular magnet 6 is mounted on the stator 7 in a sliding manner. In this case, the annular magnet 6 is provided with a corresponding coating which is composed of a suitable sliding material. This design is not suitable for the use of high delivery pressures and with liquids which exhibit poor lubrication properties, for example gasoline or diesel.

The open side of the housing 5 of the internal gear pump 1 is closed by means of a connection cover 9, with a sealing element 10 being provided in order to seal off the gap between the connection cover 9 and the housing 5 in a fluid-tight manner. The sealing element 10 is designed as an O-ring and is arranged in a corresponding encircling groove (not illustrated) inside the connection cover 9.

Figure 2:
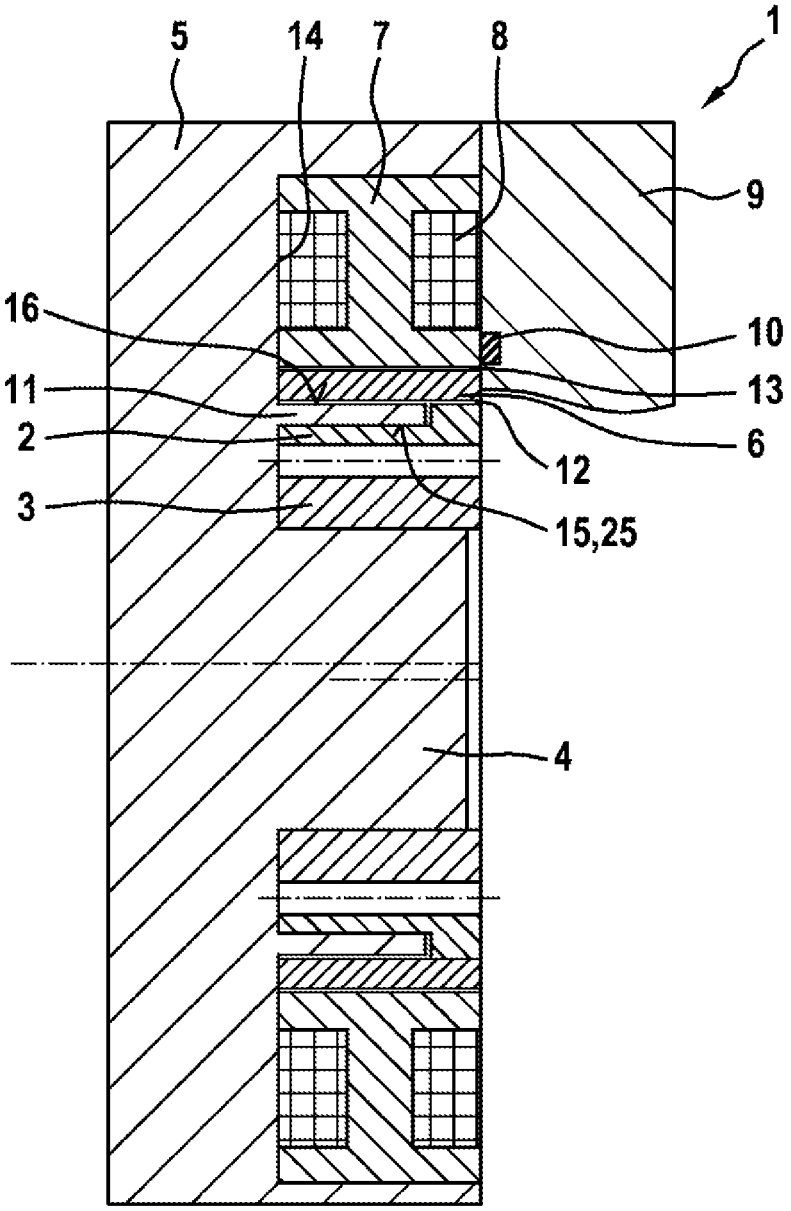
FIG. 2 shows a section through an internal gear pump according to one embodiment.

FIG. 2 shows a section through an internal gear pump 1 according to one embodiment. The internal gear pump 1 according to the embodiment and illustrated here differs substantially from the internal gear pump 1 illustrated in FIG. 1 in that the annular magnet 6 does not adopt the bearing function but rather the external ring or the annular gear 2 is mounted by a sliding bearing. The annular magnet 6 and the annular gear 2 are connected either in an interlocking manner or the connection is established in the embodiment by, for example, adhesive bonding of the two components to one another. A drive torque is therefore transmitted by a rotating electromagnetic field to the annular magnet 6 and further to the annular gear 2 of the internal gear pump 1. In order to realize magnetic decoupling between the components, the gearwheel 3 is produced from non-magnetic material. In order to realize the sliding bearing on the annular gear 2, an annular section 11 is provided, this annular section being formed in one piece or integrally with the housing 5 in this case and projecting radially from an inner wall 14 of the housing 5. The annular section 11 is formed as a sliding bearing 25 on a first surface 15 which is opposite the annular gear 2. There is a first radial gap 12 between a second surface 16 of the annular section 11, which is opposite the annular magnet 6, and the annular magnet 6. A further second radial gap 13 is designed with low values between the annular magnet 6 and the stator 7 with the objective of achieving good torque transmission and low hydraulic friction. The width of the second radial gap 12, 13 is in a range of from 0.1 to 0.5 mm.

Figure 3:
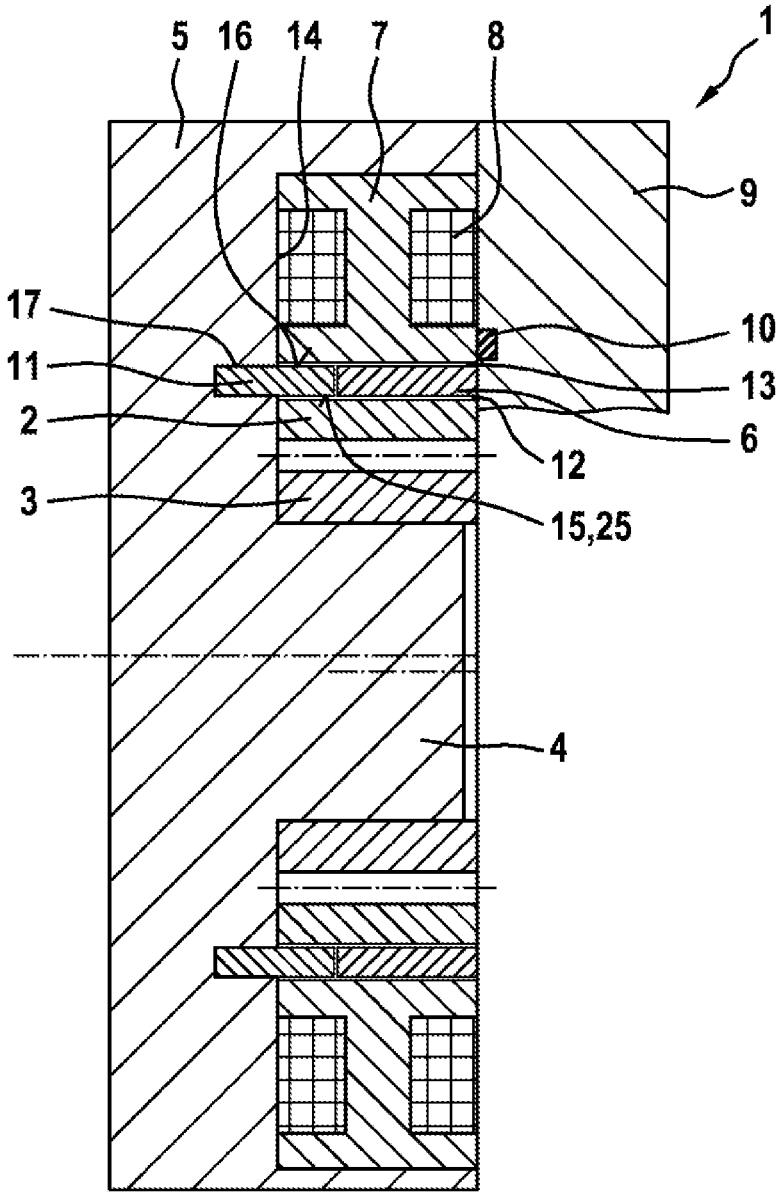
FIG. 3 shows a section through an internal gear pump according to a further embodiment.

FIG. 3 shows a section through an internal gear pump 1 according to a further embodiment which differs from the internal gear pump 1 illustrated in FIG. 2 in that, in this embodiment, the annular section 11 is not integrally produced with the housing 5 but rather is produced as a separate component. The annular section 11 with a bearing function is pressed or glued into the housing 5 or into a cutout 17 which is provided in the inner wall 14 of the housing 5.

Figure 4:
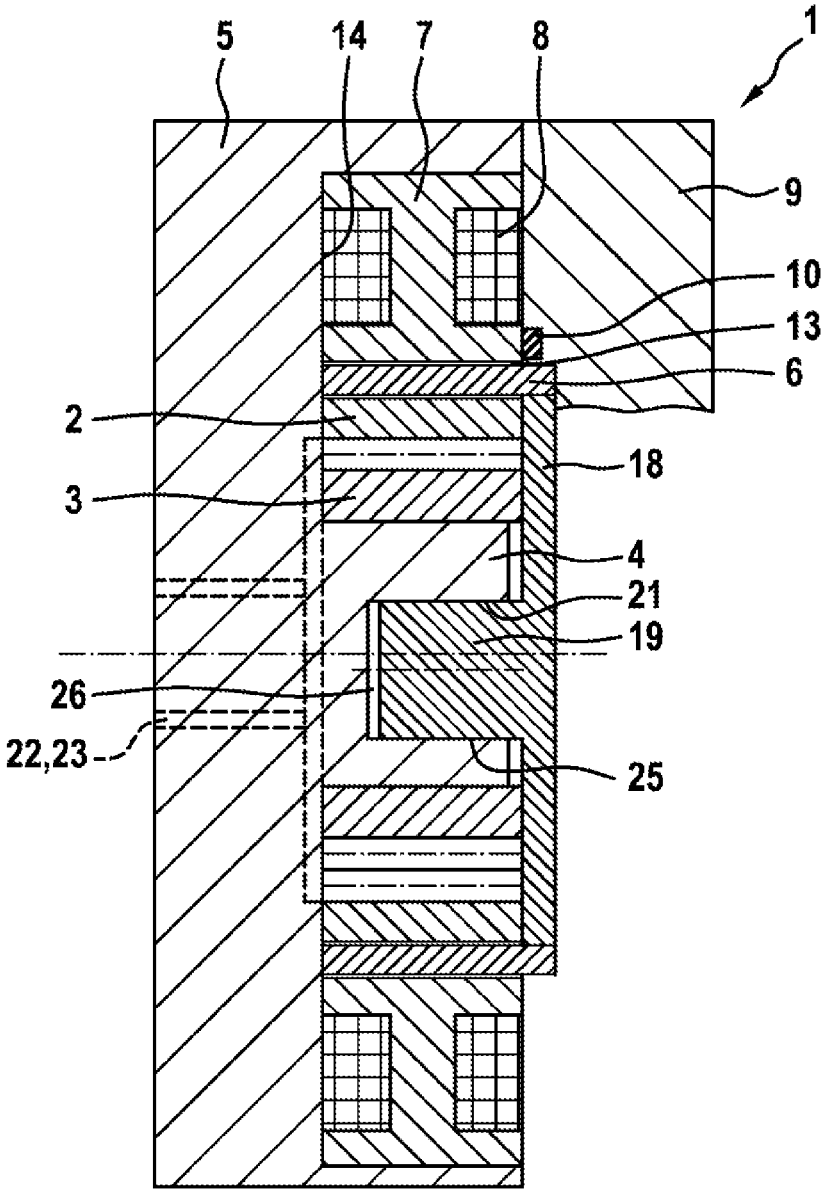
FIG. 4 shows a section through an internal gear pump according to yet a further embodiment.

FIG. 4 shows a section through an internal gear pump 1 according to yet a further embodiment, with a disk-like element 18 adopting the bearing function for the annular ring 2, said disk-like element having a bearing pin 19 which projects radially from the disk-like element 18. The bearing pin 19 of the disk-like element 18 is arranged or mounted in a recess 20 which is formed in the bearing pin 4 of the housing 5, with the disk-like element 18 bearing against the annular gear 2 from the outside. In this case, the sliding bearing 25 is provided between the bearing pin 19 of the disk-like element 18 and the bearing pin 4 of the housing 5. In this case, either the surface of the bearing pin 19 or the inner wall 21 of the recess 20, which is formed in the bearing pin 4 of the housing 5, can be in the form of a sliding bearing. In this embodiment, fuel connections 22, 23 are to be provided in the housing 5.

Figure 5:
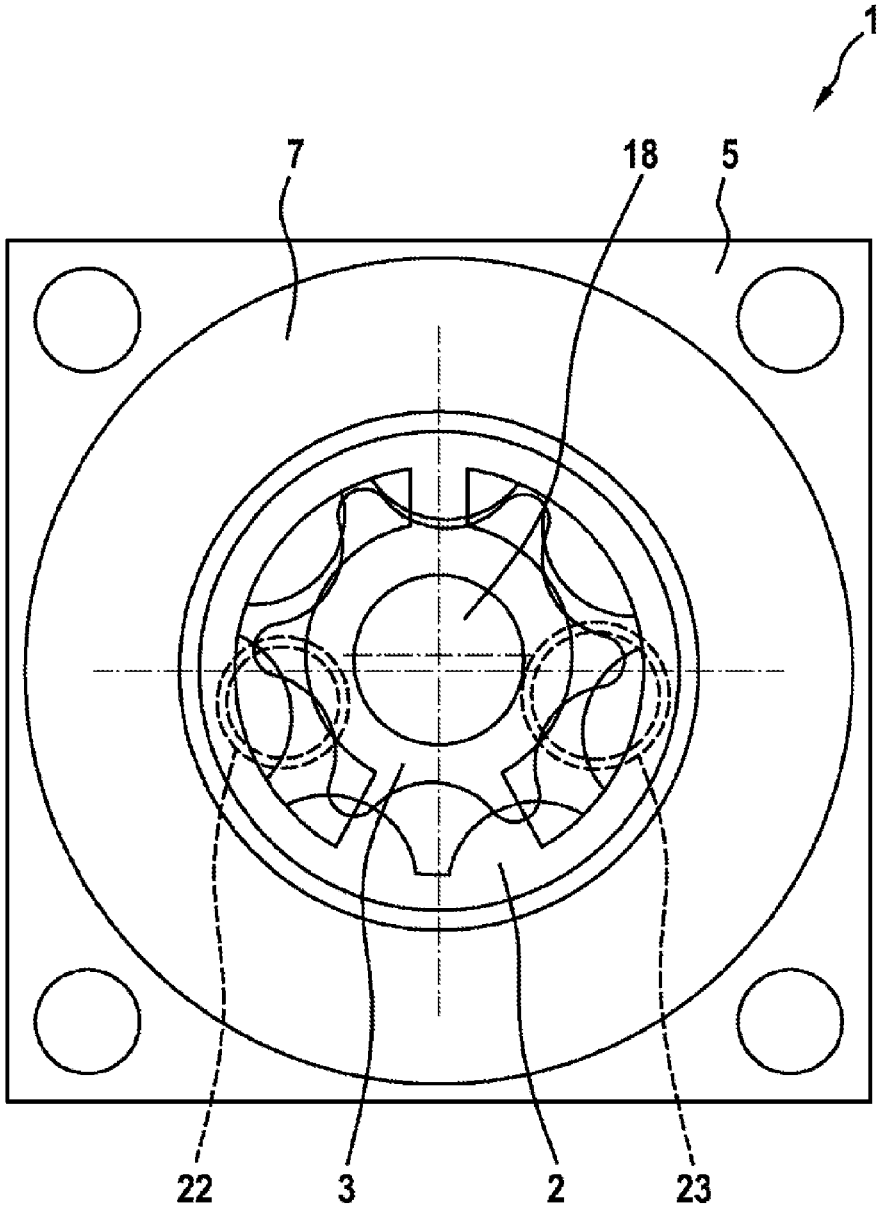
FIG. 5 shows a plan view of the internal gear pump of FIG. 4.

FIG. 5 shows a plan view of the internal gear pump 1 of FIG. 4. In this case, the position of the two fuel connections 22, 23, which are produced in the housing 5, is once again indicated by the circles which are in each case indicated using double dashed lines.

A structurally simple and therefore cost-effective sliding bearing is provided in the gear pump according to the invention.

The invention claimed is:

1. A gear pump (1) for delivering a fluid, the gear pump (1) having an externally toothed gearwheel (3), which is rotatably mounted on a bearing pin (4), and an internally toothed annular gear (2) which engages with the gearwheel (3) in a meshing manner for the purpose of generating a delivery effect, wherein the gearwheel (3) and the annular gear (2) are arranged in a housing (5) together with an electrically commutatable stator (7), with the stator (7) extending around the annular gear (2) in a concentric manner and interacting with an annular magnet (6) for the purpose of generating an electromotive force, with the annular magnet (6) being distinct and separate from the annular gear (2) and together with the annular gear (2) executing a rotary movement for the purpose of generating the delivery effect, wherein the annular gear (2) is mounted by an annular section (11) formed at least on a first surface (15) in the form of a sliding bearing (25), which is opposite the annular gear (2), the sliding bearing (25) positioned at least partially between the annular gear (2) and the annular magnet (6) in a radial direction.

2. The gear pump (1) as claimed in claim 1, characterized in that the annular magnet (6) is arranged between the stator (7) and the annular gear (2).

3. The gear pump (1) as claimed in claim 1, characterized in that the annular magnet (6) and the annular gear (2) are connected in a rotationally fixed manner.

4. The gear pump (1) as claimed in claim 1, characterized in that the annular gear (2) is produced from a non-magnetic material.

5. The gear pump (1) as claimed in claim 1, characterized in that a radial gap (13) with a value of 0.1 to 0.5 mm is formed between the stator (7) and the annular magnet (6).

6. The gear pump (1) as claimed in claim 1, characterized in that the annular section (11) is integrally formed with the housing (5) and projects radially inward from said housing.

7. The gear pump (1) as claimed in claim 1, characterized in that the annular section (11) is pressed or glued into the housing (5).

* * * * *